US012324525B2

(12) United States Patent
Mazdiyasni et al.

(10) Patent No.: US 12,324,525 B2
(45) Date of Patent: Jun. 10, 2025

(54) BRACE DEVICE AND METHOD

(71) Applicants: Parviz Paul Mazdiyasni, Irvine, CA (US); Omid Mazdiyasni, Irvine, CA (US); Arman Mazdiyasni, Irvine, CA (US)

(72) Inventors: Parviz Paul Mazdiyasni, Irvine, CA (US); Omid Mazdiyasni, Irvine, CA (US); Arman Mazdiyasni, Irvine, CA (US)

( * ) Notice: Subject to any disclaimer, the term of this patent is extended or adjusted under 35 U.S.C. 154(b) by 339 days.

(21) Appl. No.: 17/818,111

(22) Filed: Aug. 8, 2022

(65) Prior Publication Data

US 2024/0041214 A1 Feb. 8, 2024

(51) Int. Cl.

| | |
|---|---|
| ***A47C 7/36*** | (2006.01) |
| ***A47C 7/38*** | (2006.01) |
| ***A47C 16/00*** | (2006.01) |

(52) U.S. Cl.

CPC ..... *A47C 7/383* (2013.01); *A47C 16/00* (2013.01)

(58) Field of Classification Search

None

See application file for complete search history.

(56) References Cited

U.S. PATENT DOCUMENTS

| | | | | |
|---|---|---|---|---|
| 42,084 | A * | 3/1864 | Hambujer | B60N 2/2881 5/652 |
| 771,982 | A * | 10/1904 | Hiser | A61G 17/044 128/857 |
| 7,055,908 | B1 | 6/2006 | Williams | |
| 9,079,520 | B1 | 7/2015 | Hungerford | |
| 11,006,757 | B2 | 5/2021 | Titayevsky et al. | |
| 2008/0156332 | A1 | 7/2008 | Ray | |
| 2013/0165831 | A1* | 6/2013 | Thorgilsdottir | A61F 5/055 602/18 |
| 2013/0221168 | A1* | 8/2013 | Bernardoni | A47C 16/00 248/118 |
| 2013/0333708 | A1 | 12/2013 | Hassan | |
| 2021/0228396 | A1 | 7/2021 | Zimmer et al. | |
| 2022/0346553 | A1* | 11/2022 | Robinson-Platz | A47C 7/383 |

FOREIGN PATENT DOCUMENTS

| | | | | |
|---|---|---|---|---|
| GB | 2194156 A * | 3/1988 | | A61F 5/055 |
| WO | WO-2016023531 A1 * | 2/2016 | | A61F 5/055 |

* cited by examiner

*Primary Examiner* — Steven M Marsh
(74) *Attorney, Agent, or Firm* — Arman Khosraviani

(57) ABSTRACT

A brace device comprising a rest surface for resting a chin, limb, neck or head of a body, a stand surface positioned to abut a surface of the body, a connecting structure coupling the rest surface to the stand surface, a band, and an attachment means provided on the stand surface for securing the band to the stand surface.

20 Claims, 5 Drawing Sheets

BRACE DEVICE AND METHOD

FIELD OF THE DISCLOSURE

The embodiments described herein relate to bracing devices, and in particular, adjustable bracing devices for the limb, neck, chin, or head of a wearer.

BACKGROUND

For many passengers the inconveniences of air travel is a small price to pay for a rewarding experience, with several billion passengers flying every year to explore and enjoy new or familiar destinations, comfort during travel can lead to better experiences and prospects in future travel. For travelers, reaching their flight and destination can be an exhaustive process of navigating through the airport, going through security, checking in for their flight, and waiting in traffic and in lines at the airport. Moreover, on their flight or at the airport, passengers often become drowsy, restless, or fatigued and tend to fall asleep while sitting in cramped spaces. Upon waking, passengers may have chin, neck, arm, leg, or other bodily pain from, for example, incorrect posture or being sandwiched in a cramped space. Further, incorrect posture and discomfort from being in a cramped position can startle and wake a sleeping passenger and prevent them from remaining asleep or returning to sleep. Whether traveling for work or leisure, many transportation options exist for travelers, for example, travel by plane, train, metro, boat, trolley, bus, or other vehicle, where many, if not all, travelers must travel in an upright seating position. Moreover, many other factors such as weather, commute time, distance and time of commute, walking and waiting times to reach their transport, and traffic conditions can cause commuters, travelers, or passengers to become drowsy, restless, or fatigued before reaching their destination.

Incorrect sitting and sleeping posture is very common and much easier and more comfortable to maintain than the proper upright seating or sleeping posture. Most seats on aircraft, trains, buses, and the like, have limited reclining capacity and seating space making it more difficult to maintain a proper sleeping posture in an upright seating position. Further, incorrect sitting and sleeping posture during travel causes discomfort and body pain making it difficult to relax and fall asleep while sitting in upright positions, and there are short term and long term effects to improper sitting and sleeping in upright seating positions. The immediate and short term effect is discomfort, stress on the spine, chin, neck, and head making it difficult for a traveler to be productive at home, at work, or to just enjoy their day. The long term effect from incorrect sitting and sleeping posture can lead to early wear and tear, chronic pain, and surgeries. Therefore, it is important to maintain good posture and comfort in upright seating positions whenever possible.

To comfort travelers, numerous neck, chin, leg, shoulder, and head support products were developed. For example, neck blankets and neck pillows filled with filler material, air, or made of memory foam were made that are placed on a wearer's shoulders and go around the back of the wearer's neck. These neck blankets and neck pillows provide wearers with a head rest around their neck that supports lying their head on a chair or shoulder to sleep. While the neck blankets and neck pillows can provide seated passengers with some cushioning between the head and seat to allow passengers to lie down, both lack the necessary support to maintain a good posture for sleeping and preventing neck strain or body pain.

Furthermore, neck blankets and neck pillows still do not prevent a passenger from waking due to incorrect posture.

Other examples of passenger support products include pillows, blankets, straps, and padded support structures that secure to the passenger or wedge between the passenger and neighboring chair giving passengers support for sleeping face down on a soft or padded material. While such passenger support products use padding and an alternative sleeping posture in an attempt to mitigate discomfort, because passengers are in a cramped space these products also still fail to provide the necessary support to maintain a good posture for sleeping and to prevent neck strain, headaches, backaches, or other body pain.

As another example, various strapping products are available that secure the passenger's body to their seat to maintain a certain posture. Still, as another example, other types of straps and support products are available that attach to a neighboring seat and allow passengers to sleep with their legs stretched out to improve posture and comfort for sleep. While such strapping and support products attempt to mitigate discomfort with alternative sleeping postures, because passengers are in a cramped space it can be very difficult to obtain the correct sleeping posture for various body shapes and sizes, and consequently, for many passengers of varying body shapes and sizes, these products also fail to provide the support needed to maintain a good posture for sleeping and preventing neck strain, headaches, backaches, or other body pain. Moreover, all of these passenger support products fail to provide proper head support and correct posture to prevent the wearer from waking due to involuntary contraction of the muscles of the body which occurs when a person is beginning to fall asleep.

SUMMARY

The disclosed subject matter relates to a brace device for a chin, limb, neck or head of a body, the brace device including: a rest surface for resting the chin, limb, neck or head of the body, a stand surface positioned to abut a surface of the body, a connecting structure coupling the rest surface to the stand surface, a band, and an attachment means provided on the stand surface for securing the band to the stand surface.

The disclosed subject matter further relates to a method of supporting a chin, limb, neck or head of a body, the method including the steps of: providing a rest surface for resting chin, the limb, neck or head of the body, providing a stand surface positioned to abut a surface of the body, providing a connecting structure coupling the rest surface to the stand surface, providing a band, and securing one or more portions of the band to the stand surface.

It is understood that other configurations of the present disclosure will become readily apparent to those skilled in the art from the following detailed description, wherein various configurations of the present disclosure are shown and described by way of illustration. As will be realized, the present disclosure of other different configurations and its several details are capable of modifications in various other respects, all without departing from the subject technology. Accordingly, the drawings and the detailed description are to be regarded as illustrative in nature and not restrictive.

BRIEF DESCRIPTION OF THE DRAWINGS

Certain features of the present disclosure are set forth in the appended claims. However, for purpose of explanation, several implementations of the present disclosure are set forth in the following figures.

Figure 1A:
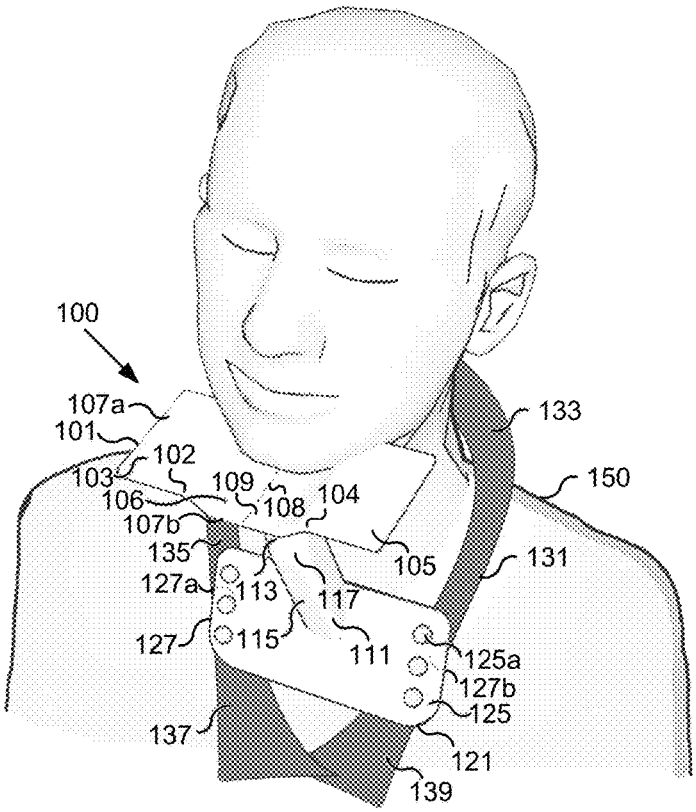
FIG. 1A illustrates a front perspective view of an example brace device in accordance with one or more embodiments of the present disclosure.

Embodiments of the present disclosure and their advantages are best understood by referring to the detailed description that follows. It should be appreciated that like-reference-numerals are used to identify like-elements illustrated in one or more of the figures.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts have been exaggerated to better illustrate details and features of the present disclosure.

Various features of the present disclosure will now be described and is not intended to be limited to the embodiments shown herein. Modifications to these features and embodiments will be readily apparent to those skilled in the art, and the principles defined herein may be applied to other embodiments without departing from the scope of the disclosure.

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

Whether traveling for work or leisure, many transportation options exist for travelers, for example, travel by plane, train, metro, boat, trolley, bus, or other vehicle, where many, if not all, travelers must travel in an upright seating position with limited reclining capacity and seating space making it more difficult to maintain a proper sleeping posture. Moreover, incorrect sitting and sleeping posture is very common and much easier and more comfortable to maintain than the proper upright seating or sleeping posture. Further, incorrect sitting and sleeping posture during travel causes discomfort and body pain making it difficult to relax and fall asleep. The immediate and short term effect is discomfort, stress on the spine, chin, neck, and head making it difficult for a traveler to be productive at home, at work, or to just enjoy their day. The long term effect from incorrect sitting and sleeping posture can lead to early wear and tear, chronic pain, and surgeries. To comfort travelers, numerous neck, chin, leg, shoulder, and head support products were developed, however these products fail to provide seated travelers and passengers with proper support and posture for sitting and sleeping to prevent neck strain, headaches, backaches, or other body pain. Still, some products offer an alternative sleeping posture in an attempt to mitigate discomfort, however, because passengers comprise of various body shapes and sizes, it can be very difficult to obtain the correct sleeping posture for many passengers. Consequently, these products also fail to provide proper support and posture for sleeping to prevent neck strain, headaches, backaches, or other body pain. Moreover, all of these passenger support products fail to provide proper head support and correct posture to prevent the wearer from waking due to involuntary contraction of the muscles of the body which occurs when a person is beginning to fall asleep. Various embodiments of the present disclosure provide a solution to one or more of the above technical problems and others. In one embodiment, a brace device, for providing proper chin, limb, neck, or head support and posture includes a rest surface for resting a chin, limb, neck or head of a wearer, the rest surface is supported by a stand surface and a connecting structure. To facilitate positioning and support the brace device on the body of the wearer, the brace device may include a band and an attachment means provided on the stand surface for securing the band to the stand surface, the band and attachment means being used to secure the brace device to the body of the wearer.

FIG. 1A illustrates a front perspective view of an example brace device in accordance with one or more embodiments of the present disclosure. As shown in FIG. 1A, brace device 100 may include rest surface 101 configured for resting, for example, a chin, neck, limb, or head of wearer 150 and connecting structure 111 for supporting the position of rest surface 101 as desired by wearer 150. The brace device 100 may also include stand surface 121 configured for supporting the connecting structure 111 and the position of rest surface 101 as desired by wearer 150.

Rest surface 101 includes upper surface 107*a* and lower surface 107*b*. Rest surface 101 may be a chin plate, chin support, chin rest, or the like. In some embodiments, rest surface 101 may be a neck plate, neck support, neck rest, or the like. Still, in some embodiments, rest surface 101 may be a head plate, head support, head rest, or the like. Rest surface 101 may include one or more layers giving it a desired thickness, cushioning or padding, contour, rigidity, or planarity to support the chin, neck, limb, or head of the wearer 150.

The upper surface 107*a* may include central portion 106 and one or more lateral portions 103 and 105 attached to the central portion 106 at interfaces 102 and 104, respectively. In some embodiments, lateral portions 103 and 105 may be planar surfaces that extend away from interfaces 102 and 104, respectively. Central portion 106 may include one or more non-planar portions positioned laterally along central portion 106 and configured to support the chin, neck, limb, or head of the wearer 150 resting on central portion 106. In some embodiments, the non-planar portion of central portion 106 includes at least one concave portion or groove 109 formed between interfaces 102 and 104 with lateral portions 103 and 105 on upper surface 107*a* forming planar surfaces extending away from the interfaces 102 and 104. Referring to FIG. 5C, the groove angle V is the angle of the intersection of the tangents at the ends of the groove 509 at interface 502 and 504, the groove angle V is configured to be between approximately 5° to 45°. The groove angle V is determined at the surface of the groove 509 in central portion 506 (below padding 510) and formed between the normal of the rest surface 501 at center line 508 and interface 502 and the normal of the rest surface 501 at center line 508 and interface 504.

The stand surface 121 includes front surface 125 and back surface 127 opposite to the front surface 125. The back surface 127 may be configured to comfortably secure the stand surface 121 to a wearer's body through connecting material 131 and back attachment means positioned on back surface 127. In some embodiments, front surface 125 may be configured to comfortably secure the stand surface 121 to a wearer's body through connecting material 131 and front attachment means positioned on front surface 125.

The connecting material 131 may be, for example, a belt, a strap, a band, a fabric, a scarf, a multi-segmented belt, strap, band, fabric, or any combination thereof. The connecting material 131 includes first end 139, second end 137, first wrap portion 133, second wrap portion 135. In some embodiments, first and second wrap portions 133, 135 are configured to wrap around wearer 150 and secure to back surface 127 through back attachment means.

In some embodiments, only front surface 125 with front attachment means is used to secure the stand surface 121 to the wearer. In some embodiments, only the back surface 127 with front attachment means is used to secure the stand surface 121 to the wearer. In some embodiments, both front surface 125 with front attachment means and back surface 125 with back attachment means are used to secure the stand surface 121 to the wearer. In some embodiments, one end of connecting material 131 may be fixed to stand surface 121 at either the front surface 125 or the back surface 127, and the opposite end of connecting material 131 may be attached to either front surface 125 with front attachment means or back surface 125 with back attachment means to secure stand surface 121 to the wearer 150.

The front surface 125 may include one or more attachment points 125*a*, attachment points 125*a* may be, for example, any one or more protrusions, clips, buckles, hooks, screws, openings, bands, fasteners, magnets, Velcro or Velcro pads, zippers, buttons, or the like, and any combination thereof. Moreover, the attachment points 125*a* may be detachably coupled to front surface 125 through, for example, a removable hook or button that slides or fixes into place on the front surface 125. In some embodiments, the front surface 125 may include a plurality of attachment points 125*a*. In some embodiments, front surface 125 may include one attachments point 125*a*, a plurality of attachment points 125*a*, or no attachment point. Moreover, each attachment point 125*a* may be the same type or of a different type from one another. In some embodiments, each attachment point 125*a* may be used to hold or secure a device (e.g., mobile device).

The back surface 127 may include one or more attachment points 127*a*, 127*b*, the attachment points 127*a*, 127*b* may be, for example, any one or more protrusions, clips, buckles, hooks, screws, openings, bands, fasteners, magnets, Velcro or Velcro pads, zippers, buttons, or the like, and any combination thereof. Moreover, the attachment points 127*a*, 127*b* may be detachably coupled to back surface 127 through, for example, a removable hook or button that slides or fixes into place on the back surface 127. In some embodiments, the back surface 127 may include one or more attachment points 127*a* and 127*b* at each end of back surface 127. In some embodiments, back surface 127 may include one attachment point 127*a*, two attachment points 127*a*, 127*b*, or no attachment point. Moreover, each attachment point 127*a*, 127*b* may be the same type or of a different type from one another. In some embodiments, the back surface 127 may be configured to have one or more attachments points 127*a* at one end of back surface 127.

The lower surface 107*b* of rest surface 101 may be configured to have one or more non-planar, grooved, or concave surface similar to central portion 106, groove 109, and planar surfaces extending away from the interfaces 102 and 104 along lateral portions 103 and 105. In some embodiments, the lower surface 107*b* may be configured to have a planar, curvilinear, or curve surface.

The connecting structure 111 may be coupled, mounted, fixed, attached, or detachably attached to the lower surface 107*b* of rest surface 101. In some embodiments, connecting structure 111 may include one or more portions formed between lower surface 107*b* of rest surface 101 and front surface 125 of stand surface 121. In some embodiments, an end of one portion of the connecting structure 111 may be configured to be coupled, mounted, fixed, attached, or detachably attached to the lower surface 107*b* of rest surface 101. In some embodiments, connecting structure 111 may include first portion 113 extending at a first angle from lower surface 107*b* and second portion 115 extending at a second angle from an end of the first portion 113. In some embodiments, the connecting structure 111 may include third portion 117 formed between first portion 113 and second portion 115 and configured to give second portion 115 an offset angle from first portion 113. In some embodiments, an end of the second portion 115 may be configured to be coupled, mounted, fixed, attached, or detachably attached to the front surface 125 of the stand surface 121. The connecting structure 111 may be, for example, substantially cylindrical in shape or rectangular in shape.

Figure 1B:
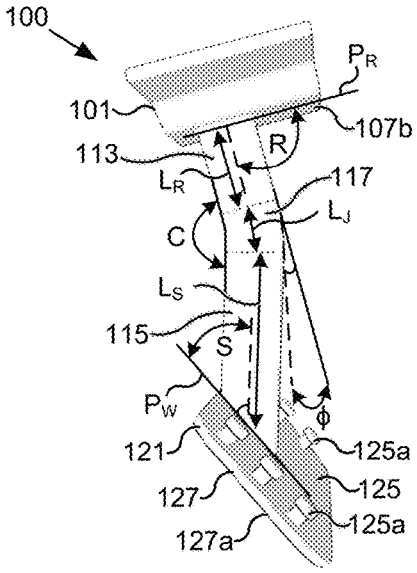
FIG. 1B illustrates an example configuration of an example brace device in accordance with one or more embodiments of the present disclosure.

FIG. 1B illustrates an example configuration of an example brace device in accordance with one or more embodiments of the present disclosure. As shown in FIG.

1B, brace device 100 may include first portion 113, second portion 115, and third portion 117 each of which extend at different angles from the rest surface 101. The first portion 113 may be configured to have a predetermined length $L_R$ extending from rest surface 101 and the second portion 115 may be configured to have a predetermined length $L_S$ extending from stand surface 121. In some embodiments, the third portion 117 may be configured to have a predetermined length $L_J$ extending between the first portion 113 and the second portion 115. The second portion 115 may extend at a second angle from an end of the first portion 113 and at a third angle from the lower surface 107*b*. In some embodiments, third portion 117 may be formed between first portion 113 and second portion 115. The third portion 117 may be configured to support better resting angle for resting surface 101 and better chest or body support angle for stand surface 121 by introducing a bend or rotation angle ϕ between first portion 113 and second portion 115. In some embodiments, the third portion 117 may be a separate material, support, or component from first portion 113 and second portion 115 to facilitate pivoting rest surface 101 and stand surface 121 or to provide one or more rotation angles ϕ between first portion 113 and second portion 115.

The rotation angle ϕ, between the first portion 113 and second portion 115 may be configured to be between approximately 0° to 90° making connecting angle C, the angle between first portion 113 and second portion 115, equal to C=180°−ϕ. For example, the first portion 113 may extend at a normal angle from lower surface 107*b*, at a rotation angle ϕ=0°, the second portion 115 would be parallel to first portion 113 making the connecting angle 180°, at a rotation angle ϕ=10°, the second portion 115 would be rotated inwards at 10°, making the angle between first portion 113 and second portion 115 making the connecting angle 170°.

The stand angle S, the angle between the second portion 115 and the stand surface 121 may be configured to be between approximately 20° to 60° to provide, for example, support for securing the stand surface 121 to the wearer's chest or body. The stand angle S may be configured with respect to a plane $P_W$ along the front surface 125 of stand surface 121 or tangent to a surface of the wearer's body.

The rest surface angle R, the angle between the lower surface 107*b* and the first portion 113 may be configured to be between approximately 60° to 120° to provide, for example, a suitable resting surface angle for resting a neck, chin, head, or limb of the wearer. The rest surface angle R may be configured with respect to a plane $P_R$ along the lower surface 107*b* of rest surface 101.

In some embodiments, depending on the desired resting surface angle with respect to the chin, head, limb, or neck of the wearer, the rotation angle ϕ, connecting angle C, stand angle S, and rest surface angle R of connecting structure 111 may be configured to provide comfort and support for the chin, neck, limb, or head of the wearer. For example, to provide a desired angle for the second portion 115 (e.g. second portion 115 being parallel to the wearer's neck), the rotation angle ϕ may be configured to be about 20°, the connecting angle C may be configured to be about 160°, the stand angle S may be configured to be about 40°, and rest surface angle R may be configured to be about 90°. Any of the rotation angle ϕ, connecting angle C, stand angle S, and rest surface angle R may be configured with respect to either a plane $P_R$ along the lower surface 107*b* of rest surface 101, or with respect to a plane $P_W$ along the front surface 125 of stand surface 121 or tangent to a surface of the wearer's body.

The length $L_R$ of the first portion 113 may be between approximately 2 to 30 centimeters. The length $L_S$ of the second portion 115 may be between approximately 2 to 30 centimeters. The length $L_J$ of the third portion 117 may be between approximately 0.5 centimeters to 10 centimeters. The length $L_R$ of the first portion 113, length $L_S$ of the second portion 115, and the length $L_J$ of the third portion 117 may be adjusted as desired to provide the desired support and a comfortable rest surface 101 angle and position for the wearer 150.

The components of the brace device 100 of the present disclosure, the rest surface 101, connecting structure 111, and stand surface 121 may be solid, hollow, substantially solid, or substantially hollow and composed of any suitable material, for example metals, plastics, reinforced materials, composites, and the like to ensure easy transport and support and comfort for the wearer. Moreover, the rest surface 101, connecting structure 111, and stand surface 121 may be formed as one piece, or a plurality of interconnecting pieces or portions to provide the desired limb, neck, chin or head support. In some embodiments, the brace device 100, for example, the rest surface 101, connecting structure 111, and stand surface 121 may be extruded, printed, molded, or otherwise fabricated together in one or multiple runs as a single piece. Moreover, any one of the brace device components: the upper surface 107*a*, lower surface 107*b*, connecting structure 111, front surface 125, back surface 127, and connecting material 131 may include a padding or cushioning fabric, material, or foam (e.g., memory foam) that covers, sleeves over, or encloses, in part or in whole, said component to obtain, for example, a desired thickness, cushioning or padding, contour, rigidity, or planarity to support the chin, neck, limb, or head of the wearer 150.

To provide proper head positioning in an upright seating position that would maintain good posture for sitting or sleeping, the wearer should maintain an appropriate level of neck tilt $N_T$. The neck tilt $N_T$ is defined as the tilt of the back of the wearer's skull from the plane that crosses the midpoint of the spine. As is well known to one of ordinary skill in the art, a neutral neck provides the least amount of head weight on the spine, that is, the further the wearer's head is tilted from the neutral neck position, the greater the pressure on the spine from the wearer's head. Therefore, it is desirable to maintain the wearer's skull in a neutral neck position, with the back of the skull being vertically aligned with the midpoint of the spine. The brace device of the present disclosure can provide a neck tilt $N_T$ of between approximately 0° to 5° to obtain a neutral neck with minimum head weight of approximately 10-12 lbs. applied to the wearer's spine. Beyond the neutral neck position, the wearer will feel more head weight and stress on their spine, causing the wearer to wake up from their sleep with discomfort and body pain and making it difficult to relax and fall asleep while sitting in upright positions. The distance and angle of rest surface 101 and stand surface 121 with respect to the wearer 150 may be configured by adjusting lengths $L_R$, $L_S$ and $L_J$ of first, second and third portions 113, 115, 117 and angles R, ϕ, C and S of the rest surface 101, the connecting structure 111, and stand surface 121 for maintaining neutral neck tilt $N_T$ of between approximately 0° to 5° thereby supporting the chin, neck, or head of the wearer 150 in an upright seating position for good sleeping and sitting posture. In some embodiments, the distance and angle of rest surface 101 and stand surface 121 with respect to the wearer 150 may be configured by adjusting lengths $L_R$, $L_S$ and $L_J$ of first, second and third portions 113, 115, 117 and angles R, ϕ, C and S of the rest surface 101, the connecting structure 111, and stand surface 121 for maintaining proper limb support, angle, positioning, and height relative to the wearer.

Figure 2:
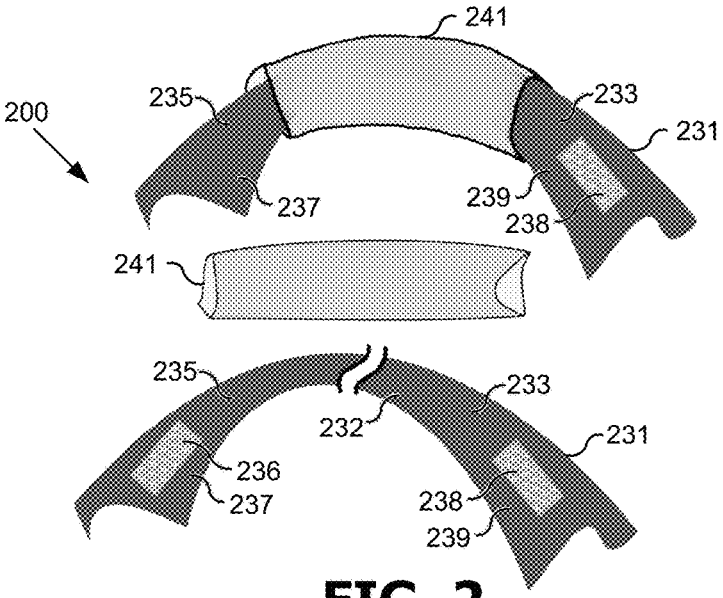
FIG. 2 illustrates an example connecting material used with a brace device in accordance with one or more embodiments of the present disclosure.

FIG. 2 illustrates an example connecting material used with a brace device in accordance with one or more embodiments of the present disclosure. As shown in FIG. 2, wearable material 200 for securing the brace device 100 to the wearer 150 may include connecting material 231 and an attachable collar 241 for cushioning and wearer comfort. The connecting material 231 includes first end 239, second end 237, first wrap portion 233, second wrap portion 235. In some embodiments, first and second wrap portions 233, 235 receive the collar 241 for cushioning and wearer comfort. Still, in some embodiments, the first and second wrap portions 233, 235 may be padded for cushioning and wearer comfort. In some embodiments, the first and second wrap portions 233, 235 are one piece with collar 249 sheathed, wrapped, attached, or covered around it. In some embodiments, first end 239, second end 237, first wrap portion 233, and second wrap portion 235 of the connecting material 231 may each be detachable from one another and lock or couple together to form connecting material 231. For example, first end 239, second end 237, first wrap portion 233, and second wrap portion 235 may each be different colored, textured or designed nylon clip/belts that couple and lock to one another at each end.

In some embodiments, one end of the connecting material 231 may be fixed to stand surface 121 with the other end detachably coupled to, and freely adjustable on, the stand surface 121 by wearer 150. The connecting material 231 may include one attachment surface 238 to facilitate securing, or removably attaching, the connecting material 231 to the stand surface 121 through the front or back attachment means. The attachment surface 238 couples, fastens, or secures to the front or back attachment means of the stand surface 121. For example, to fasten the connecting material 231 to the back surface 127, the back surface 127 may be configured to have Velcro back attachment means, the attachment surface 238 may be configured to have hook lineal strip and the back surface 127 of the stand surface 121 may be configured to have a loop lineal strip. The hook strip of attachment surface 238 fastens to the loop strip of the back surface 127. In some embodiments, the attachment surface 238 includes one or more holes to attach to a belt, button, or protrusion attachment means on the stand surface 121. The attachment surface 238 may, for example, facilitate adjustment and position of the stand surface 121 and rest surface 101 by allowing the wearer to remove and adjust the tension of the connecting material 231 or reposition the stand surface 121 or rest surface 101.

In some embodiments, both ends of the connecting material 231 may be detachably coupled to, and freely adjustable on, the stand surface 121 by wearer 150. In addition to attachment surface 238, the connecting material 231 may include second attachment surface 236 that couples, fastens, or secures to the front or back attachment means of the stand surface 121. The second attachment surface 236 may, for example, facilitate ease of access for adjustment and position of the stand surface 121 and rest surface 101 by providing an additional option for the wearer to adjust the tension of the connecting material 231 or reposition the stand surface 121 or rest surface 101.

The wearable material 200 may be positioned, connected to, secured, or attached anywhere along the body of wearer 150. For example, connecting material 231 may comprise of a band, strap, or fabric that, in part or in whole, wraps around, secures, or attaches the stand surface 121 to the body of wearer 150.

Figure 3:
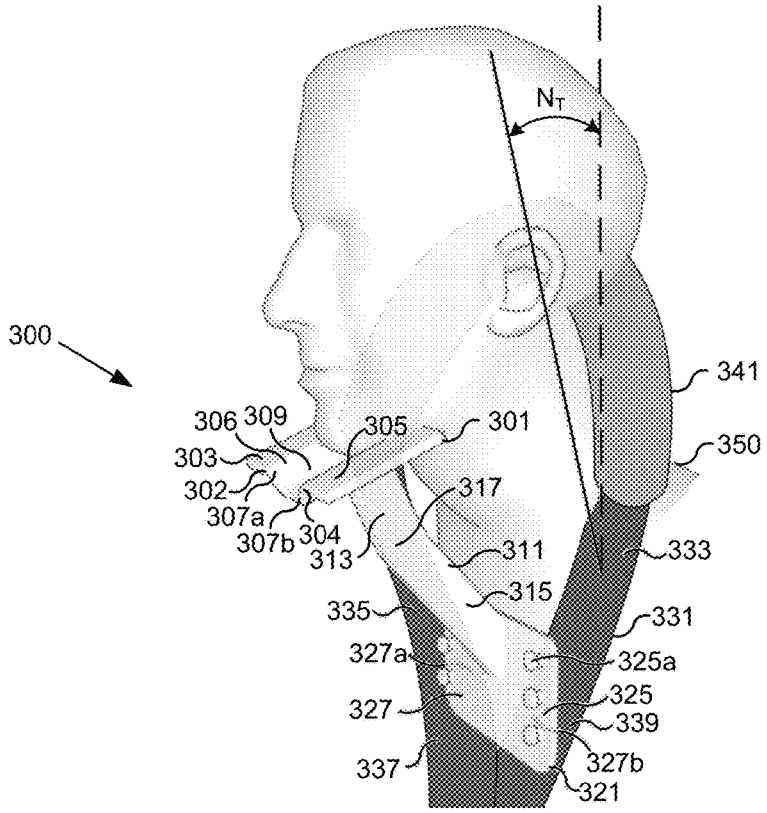
FIG. 3 illustrates a side view of an example brace device in accordance with one or more embodiments of the present disclosure.

FIG. 3 illustrates a side view of an example brace device in accordance with one or more embodiments of the present disclosure. As shown in FIG. 3, brace device 300 may be secured to the body of wearer 350 using connecting material 331 and stand surface 321. The tightness or slack of connecting material 331 and the position of stand surface 321 on the wearer's chest may be adjusted to provide desired head support and a comfortable chin rest position on rest surface 301. Further, the distance and angle of rest surface 301 and stand surface 321 with respect to the wearer 350 may be configured as desired by adjusting the lengths ($L_R$, $L_S$ and $L_J$) of first, second and third portions 313, 315, 317 and the angles (R, ϕ, C and S) of the rest surface 301, the connecting structure 311, and stand surface 321 for supporting the chin, limb, neck, or head of the wearer 350.

The rest surface 301 includes right lateral portion 303, left lateral portion 305, and central portion 306 on upper surface 307*a*. The rest surface 301 further includes joints or interfaces 302 and 304 between central portion 306 and the right lateral and left lateral portions 303, 305. One end of connecting structure 311 is fixed to lower surface 307*b*, the connecting structure 311 extends from the lower surface 307*b* and couples rest surface 301 with stand surface 321. The connecting structure 311 may include one or more portions to provide the desired head support and a comfortable chin rest position on rest surface 301. In some embodiments, the connecting structure 311 includes two portions, first portion 311 and second portion 315. In some embodiments, the connecting structure 311 includes three or more portions, for example, first portion 311, second portion 315, and third portion 317.

The stand surface 321 includes front surface 325 and back surface 327. The front surface 325 may include front attachment means having one or more attachment points 325*a* that secure the wearable material 200 or connecting material 331 to the front surface 325. The back surface 327 may include back attachment means having one or more attachment points 327*a*, 327*b* that secure the wearable material 200 or connecting material 331 to the back surface 327.

The connecting material 331 may include detachable collar 341 for cushioning and wearer comfort. The connecting material 231 includes first end 339, second end 337, first wrap portion 333, second wrap portion 335. In some embodiments, first and second wrap portions 333, 335 receive the collar 341 for cushioning and wearer comfort. Still, in some embodiments, the first and second wrap portions 333, 335 may be padded for cushioning and wearer comfort.

The distance and angle of rest surface 301 and stand surface 321 with respect to the wearer 350 may be configured by adjusting lengths $L_R$, $L_S$ and $L_J$ of first, second and third portions 313, 315, 317 and angles R, ϕ, C and S of the rest surface 301, the connecting structure 311, and stand surface 321 for maintaining neutral neck tilt $N_T$ of between approximately 0° to 5° thereby supporting the neck, head, or chin of the wearer 350 in an upright seating position for good sleeping and sitting posture. In some embodiments, the distance and angle of rest surface 301 and stand surface 321 with respect to the wearer 350 may be configured by adjusting lengths $L_R$, $L_S$ and $L_J$ of first, second and third portions 313, 315, 317 and angles R, ϕ, C and S of the rest surface 301, the connecting structure 311, and stand surface 321 for maintaining proper limb support, angle, positioning, and height relative to the wearer.

Figure 4:
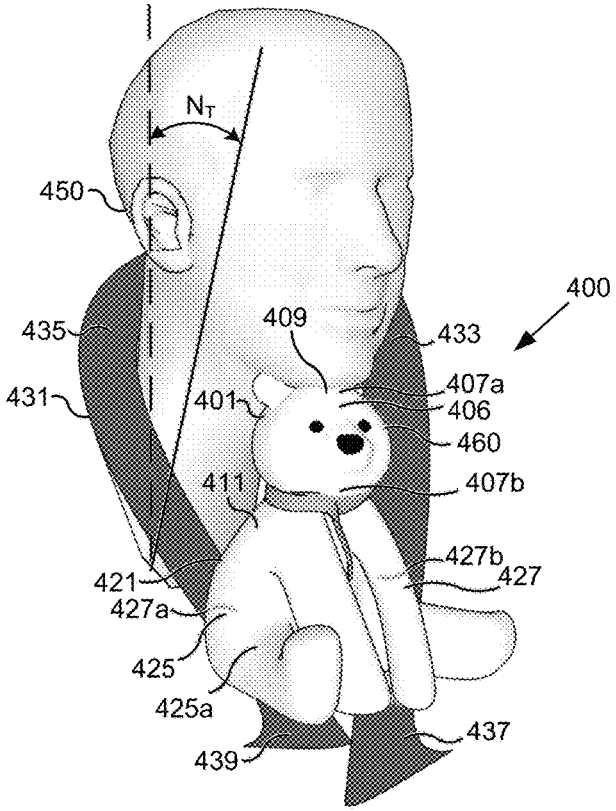
FIG. 4 illustrates a front perspective view of an example brace device being a toy, doll, or stuffed animal, or an example brace device being sheathed in a toy, doll, or stuffed animal cover in accordance with one or more embodiments of the present disclosure.

FIG. 4 illustrates a front perspective view of an example brace device in accordance with one or more embodiments of the present disclosure. As shown in FIG. 4, the rest surface 401, connecting structure 411, and the stand surface 421 of brace device 400 may each be covered by one or more parts of a toy, doll, or stuffed animal (hereinafter "stuffed animal 460"). In some embodiments, the stuffed animal 460 may include components of brace device 400. The rest surface 401 may form the head of stuffed animal 460, connecting structure 411 may form the neck, upper torso or abdomen of stuffed animal 460, and the stand surface 421 may form the limbs, back, or lower torso or abdomen of stuffed animal 460. For example, the head of stuffed animal 460 may form upper surface 407*a* and lower surface 407*b* of rest surface 401. The torso of stuffed animal 460 may include front surface 425 and back surface 427. The front surface 425 may include one or more attachment points 425*a* (e.g. limbs, legs, or torso of the stuffed animal 460) and an attachment means for securing stand surface 421 to the wearer 450. Further, the back surface 427 may include one or more attachment points 427*a* and 427*b* and an attachment means for securing stand surface 421 to the wearer through connecting material 431. In central portion 406 of rest surface 401 includes non-planar portion 409 formed in upper surface 407*a* to provide the desired head support and a comfortable chin rest position on rest surface 401.

The connecting material 431 may include detachable collar 241 for cushioning and wearer comfort. The connecting material 431 includes first end 439, second end 437, first wrap portion 433, second wrap portion 435. In some embodiments, first and second wrap portions 433, 435 receive the collar 241 for cushioning and wearer comfort. Still, in some embodiments, the first and second wrap portions 433, 435 may be padded for cushioning and wearer comfort.

The distance and angle of rest surface 401 and stand surface 421 with respect to the wearer 450 may be configured by adjusting lengths $L_R$, $L_S$ and $L_J$ of first, second and third portions of the connecting structure 411 and angles R, ϕ, C and S of the rest surface 401, the connecting structure 411, and stand surface 421 for maintaining neutral neck tilt $N_T$ of between approximately 0° to 5° thereby supporting the neck, head, or chin of the wearer 450 in an upright seating position for good sleeping and sitting posture. In some embodiments, the brace device 400 is configured as desired to maintain neutral neck tilt $N_T$ when sheathed or covered by a toy, doll, or stuffed animal. In some embodiments, the brace device 400 may be a toy, doll, or stuffed animal with predetermined lengths $L_R$, $L_S$ and $L_J$ of first, second and third portions of the connecting structure 411 and predetermined angles R, ϕ, C and S of the rest surface 401, the connecting structure 411, and stand surface 421 for maintaining neutral neck tilt $N_T$ of between approximately 0° to 5° thereby supporting the neck, head, or chin of the wearer 350 in an upright seating position for good sleeping and sitting posture. In some embodiments, the distance and angle of rest surface 401 and stand surface 421 with respect to the wearer 450 may be configured by adjusting lengths $L_R$, $L_S$ and $L_J$ of first, second and third portions of the connecting structure 411 and angles R, ϕ, C and S of the rest surface 401, the connecting structure 411, and stand surface 421 for maintaining proper limb support, angle, positioning, and height relative to the wearer.

Figure 5A:
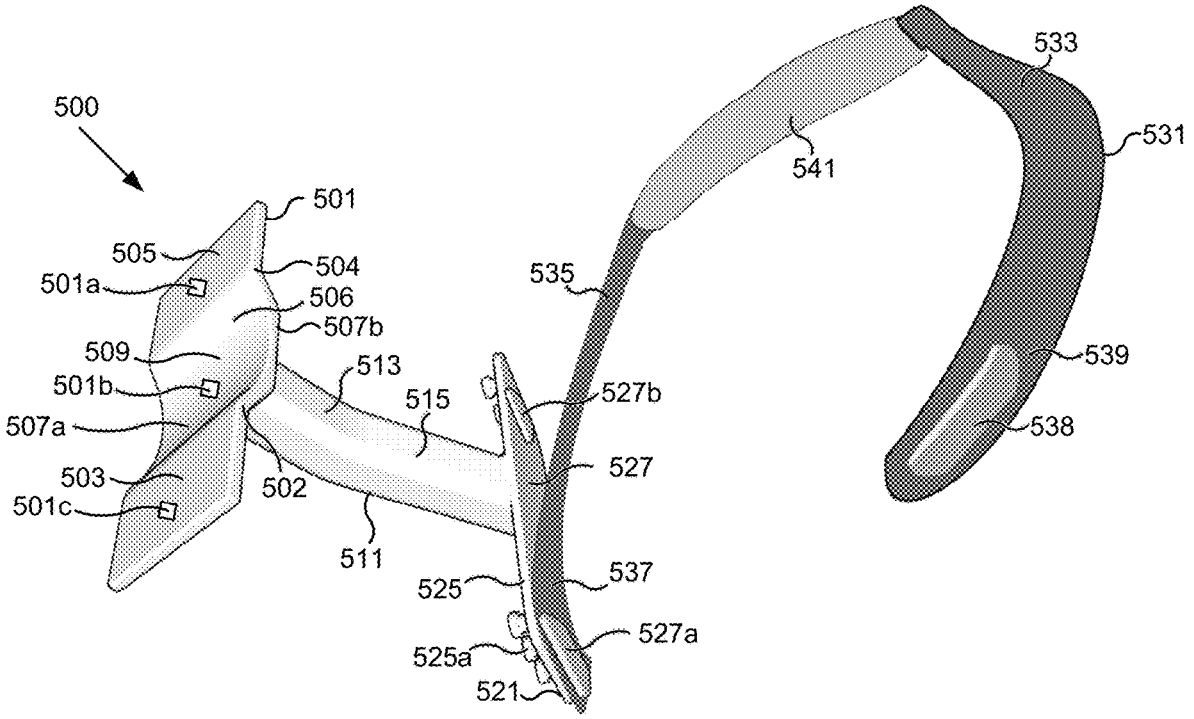
FIG. 5A illustrates an example connecting material connected to an example brace device in accordance with one or more embodiments of the present disclosure.

FIG. 5A illustrates an example connecting material connected to an example brace device in accordance with one or more embodiments of the present disclosure. As shown in FIG. rest surface 501 may include one or more attachment points 501*a*, 501*b*, and 501*c* either on upper surface 507*a* or lower surface 507*b*, or both, for attaching a padding or cushioning fabric, material, or foam (e.g., memory foam) that covers the rest surface 501, in part or in whole, to obtain, for example, a desired thickness, cushioning or padding, contour, rigidity, or planarity to support the chin, neck, limb, or head of the wearer 150. The attachment points 501*a*, 501*b*, and 501*c* may include one or more attachment means, for example, any one or more protrusions, clips, buckles, hooks, screws, openings, bands, fasteners, magnets, Velcro or Velcro pads, zippers, buttons, or the like, and any combination thereof for securing a padding or cushioning fabric, material, or foam (e.g., memory foam) to the brace device 500.

In some embodiments, the padding cover may include one or more parts of a toy, a doll, or a stuffed animal. In some embodiments, a head of stuffed animal 460 may enclose, cover, or sleeve over the rest surface 501, central portion 506, groove 509, and left lateral and right lateral portions 503 and 505 to support the chin, neck, limb, or head of the wearer 150. Moreover, any one of attachment points 501*a*, 501*b*, and 501*c* may be positioned on interface 502 or 504 to support one or more padding covers (e.g., the head of stuffed animal 460). In some embodiments, a plurality of attachment points 501*a*, 501*b*, and 501*c* are positioned on the brace device 500. For example, one or more attachments points 501*a*, 501*b*, and 501*c* may be positioned on connecting structure 511, first portion 513, second portion 515, stand surface 521, front surface 525, and back surface 527 to support one or more padding covers (e.g., the body, or parts of, a toy, doll, or stuffed animal).

The brace device 500 includes connecting material 531 fixed at the first end 537 to back attachment point 527*a* of back surface 527. In this example, the back attachment means may be, for example, glue, epoxy, rivet that secures the first end 537 to back surface 527. In some embodiments, the back attachment means may be by stamping, pressing, gluing, or otherwise adhering a portion of the first end 537 to the back attachment point 527*a*. In some embodiments, attachment point 527*a* may be one or more structures that is positioned over first end 537 and stamped, pressed, adhered or otherwise secured to the back surface 527. The brace device 500 further includes another attachment point 527*b* that detachably couples or secures attachment surface 238 on the second end 539 of connecting material 531. In some embodiments, the back attachment means may further include stamping, pressing, gluing, or otherwise adhering a portion of the second end 539 to the back attachment point 527*b*. The connecting material 531 may then be stretched or pulled over the body of the wearer, first end 537, second end 539, first and second wrap portions 533 and 535 may each be nylon clip/belts that detachably coupled to one another, and the collar 541 may removably attached to connecting material 531. In some embodiments, attachment point 527*b* may be one or more structures that is positioned over first end 539 and stamped, pressed, adhered or otherwise secured to the back surface 527. In some embodiments, padding or collar 541 may be fixed to the connecting material 531 between first and second wrap portions 533 and 535.

Figure 5B:
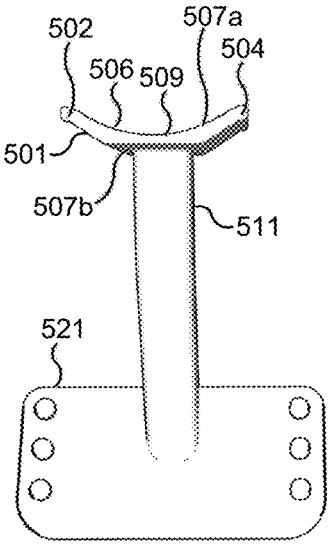
FIG. 5B illustrates an example brace device in accordance with one or more embodiments of the present disclosure.
Figure 5C:
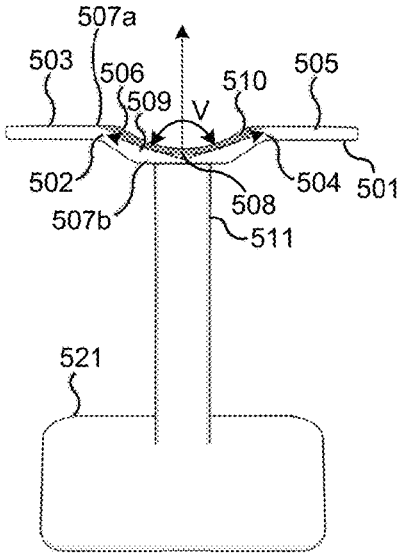
FIG. 5C illustrates another example brace device in accordance with one or more embodiments of the present disclosure.

FIG. 5B illustrates an example brace device in accordance with one or more embodiments of the present disclosure. As shown in FIG. 5B, the rest surface 501 may exclude left and right lateral portions 503 and 505 with the central portion 506 and groove 509 extending between interfaces 502 and 504 which also form the edges of the upper surface 507*a* and lower surface 507*b*. Moreover, the connecting structure 511 may form continuous curved structure that attaches stand surface 521 to rest surface 501.

FIG. 5C illustrates another example brace device in accordance with one or more embodiments of the present disclosure. As shown in FIG. 5C, the rest surface 501 may include a memory foam or padding 510 attached over part or all of the central portion 506 and groove 509. Moreover, increasing the thickness of padding 501 reduces the groove angle V to provide the desired contour or cushioning to support the chin, neck, limb, or head of the wearer 150. The groove angle V is the angle of the intersection of the tangents at the ends of the groove 509 at interface 502 and 504, the groove angle V is configured to be between approximately 5° to 45°. The groove angle V is determined at the surface of the groove 509 in central portion 506 (below padding 510) and formed between the normal of the rest surface 501 at center line 508 and interface 502 and the normal of the rest surface 501 at center line 508 and interface 504. Moreover, the connecting structure 511 may form a single rigid or continuous structure, for example substantially cylindrical or substantially rectangular in shape, that attaches stand surface 521 to rest surface 501.

Referring to FIGS. 5A-5C, and as described above, the distance and angle of rest surface 501 and stand surface 521 with respect to the wearer may be configured by adjusting lengths $L_R$, $L_S$ and $L_J$ of first, second and third portions of the connecting structure 511 and angles R, ϕ, C and S of the rest surface 501, the connecting structure 511, and stand surface 521 for maintaining neutral neck tilt $N_T$ of between approximately 0° to 5° thereby supporting the neck, head, or chin of the wearer in an upright seating position for good sleeping and sitting posture. In some embodiments, the distance and angle of rest surface 101 and stand surface 121 with respect to the wearer may be configured by adjusting lengths $L_R$ $L_S$ and $L_J$ of first, second and third portions of connecting structure 511 and angles R, ϕ, C and S of the rest surface 501, the connecting structure 511, and stand surface 521 for maintaining proper limb support, angle, positioning, and height relative to the wearer.

Figure 6A:
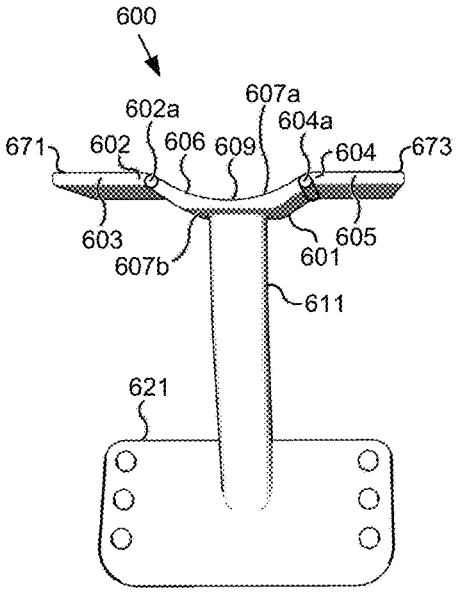
FIG. 6A illustrates an example brace device with one or more movable surfaces in accordance with one or more embodiments of the present disclosure.

FIG. 6A illustrates an example brace device with one or more movable surfaces in accordance with one or more embodiments of the present disclosure. As shown in FIG. 6A, brace device 600 includes rotatable flaps 671 and 673 connected to pivoting structures 602*a* and 604*a*, respectively. The pivot structure 602*a* and 604*a* may be a barrel attached at interface 602 and 604, respectively. The flap 671 may form the right lateral portion 603 and flap 673 may form the left lateral portion 605 on rest surface 601. The upper surface 607*a* includes central portion 606 and groove 609. In some embodiments, lower surface 607*b* may be configured to have one or more non-planar, grooved, or concave surfaces similar to groove 609 of central portion 606 and planar surfaces extending away from the interfaces 602 and 604 along right and left lateral portions 603 and 605. In some embodiments, the lower surface 607*b* may be configured to have a planar, curvilinear, or curve surface. The rest surface 601 being fixed to stand surface 621 through connecting structure 611.

Figure 6B:
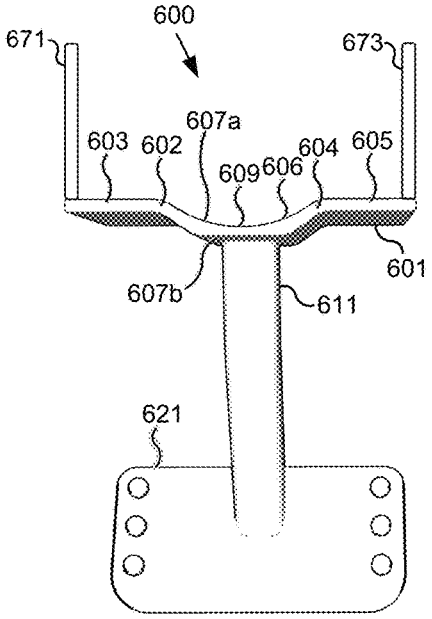
FIG. 6B illustrates another example brace device with side flaps in accordance with one or more embodiments of the present disclosure.

FIG. 6B illustrates another example brace device with side flaps in accordance with one or more embodiments of the present disclosure. As shown in FIG. 6A, brace device 600 includes fixed flaps 671 and 673 connected either at the ends of right and left lateral portions 603 and 605, or at the outside edges of right and left lateral portions 603 and 605. In some embodiments, side flaps 671, 673 are mounted, fixed, or otherwise attached adjacent to or along the outer edge of rest surface 601. As an example, the wearer may use side flaps 671, 673 to vertically position their chin, limb, neck or head at a desired angle above rest surface 601.

Figure 6C:
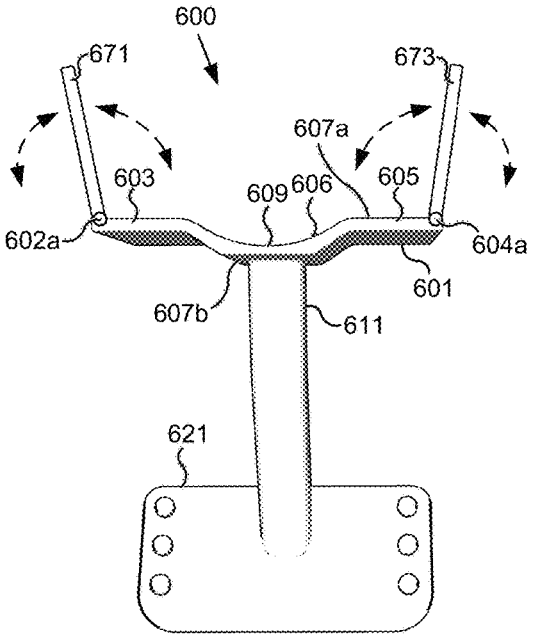
FIGS. 6C-6D illustrate another example brace device with one or more movable surfaces in accordance with one or more embodiments of the present disclosure.
Figure 6D:
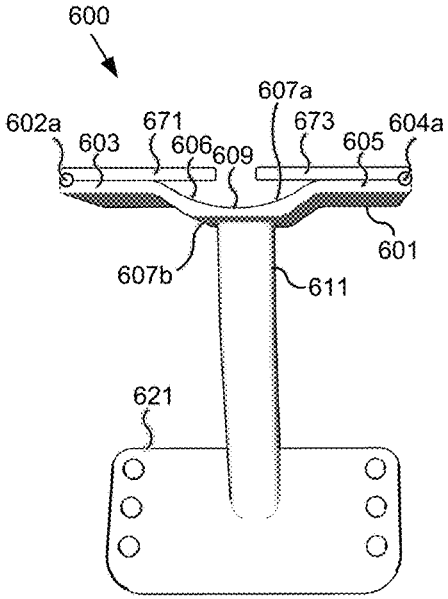

FIGS. 6C-6D illustrate another example brace device with one or more movable surfaces in accordance with one or more embodiments of the present disclosure. As shown in FIGS. 6C-6D, brace device 600 includes rotatable flaps 671 and 673 connected to pivoting structures 602*a* and 604*a*, respectively. The pivot structure 602*a* and 604*a* may be a barrel attached at interface 602 and 604, respectively. The flaps 671 and 673 may folded down over right lateral portion 603 and flap 673 for storage or transport. The upper surface 607*a* includes central portion 606, groove 609. In some embodiments, lower surface 607*b* may be configured to have one or more non-planar, grooved, or concave surface similar to groove 609 of central portion 606 and planar surfaces extending away from the interfaces 602 and 604 along right and left lateral portions 603 and 605. In some embodiments, the lower surface 607*b* may be configured to have a planar, curvilinear, or curve surface. In some embodiments, one or more flaps 671, 673 are movable, for example, pivotable, rotatable, etc., and are mounted, fixed, or otherwise attached adjacent to or along the outer edge of rest surface 601. As an example, the wearer may use movable flaps 671, 673 to position each flap 671, 673 at a desired angle to vertically position their chin, limb, neck or head at a desired angle above rest surface 601.

Referring to FIGS. 6A-6D, and as described above, the distance and angle of rest surface 601 and stand surface 621 with respect to the wearer may be configured by adjusting lengths $L_R$, $L_S$ and $L_J$ of first, second and third portions of the connecting structure 611 and angles R, ϕ, C and S of the rest surface 601, the connecting structure 611, and stand surface 621 for maintaining neutral neck tilt $N_T$ of between approximately 0° to 5° thereby supporting the neck, head, or chin of the wearer in an upright seating position for good sleeping and sitting posture. In some embodiments, the distance and angle of rest surface 601 and stand surface 621 with respect to the wearer may be configured by adjusting lengths $L_R$ $L_S$ and $L_J$ of first, second and third portions of connecting structure 611 and angles R, ϕ, C and S of the rest surface 601, the connecting structure 611, and stand surface 621 for maintaining proper limb support, angle, positioning, and height relative to the wearer.

Figure 7:
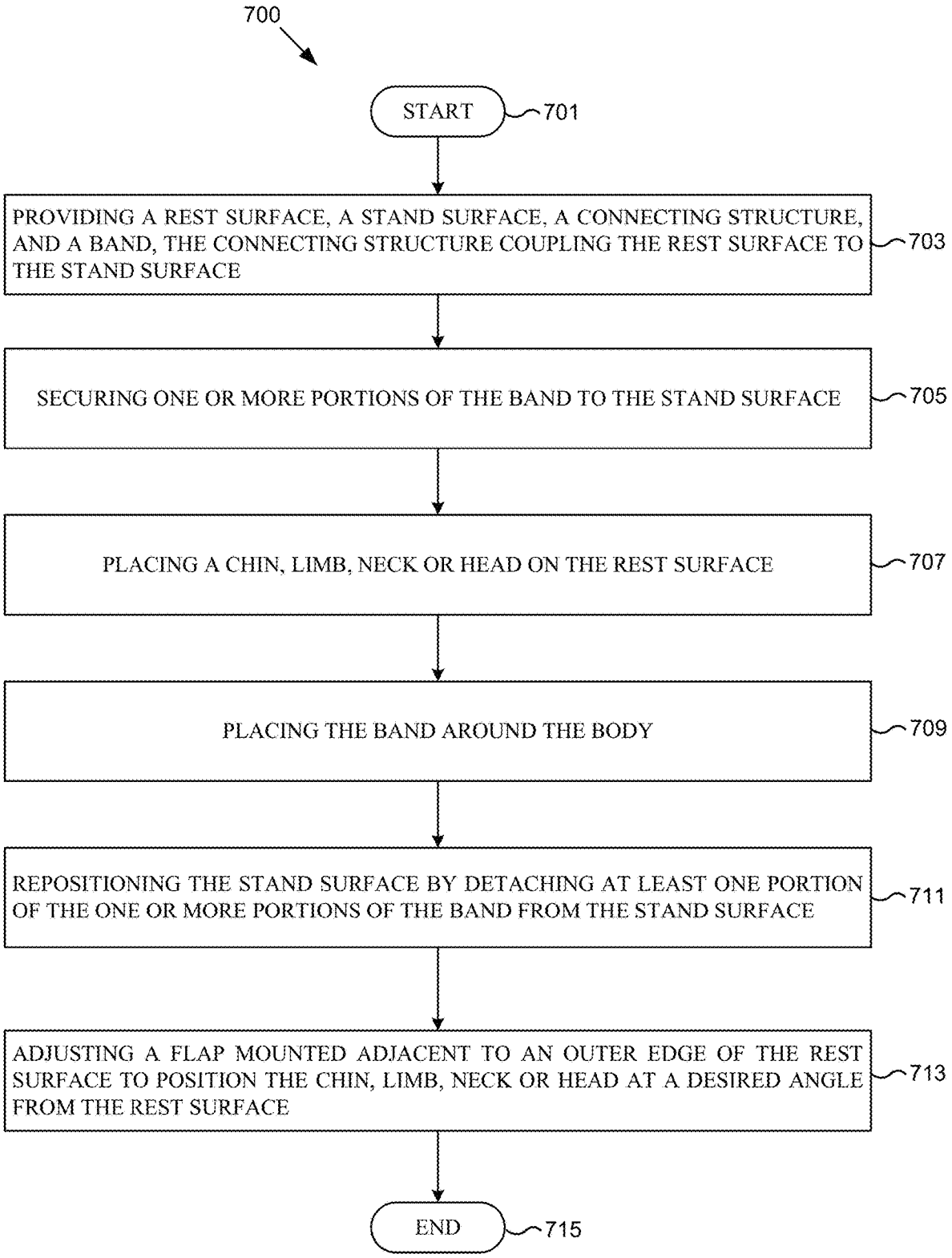
FIG. 7 illustrates an example flow chart showing a method of supporting a chin, limb, neck, or head of a wearer in accordance with one or more embodiments of the present disclosure.

FIG. 7 illustrates an example flow chart showing a method of supporting a limb, neck, chin, or head of a wearer of a bracing device in accordance with one or more embodiments of the present disclosure. These exemplary methods are provided by way of example, as there are a variety of ways to carry out these methods. Each block shown in FIG. 7 represents one or more processes, methods or subroutines, carried out in the exemplary method. FIGS. 1A-6D show example embodiments of carrying out the method of FIG. 7 for supporting a limb, neck, chin, or head of a wearer of a bracing device. Each block shown in FIG. 7 represents one or more processes, methods or subroutines, carried out in the exemplary method. The exemplary method may begin at block 701. Method 700 may be used independently or in combination with other methods or process for supporting a limb, neck, chin, or head of a wearer of a bracing device. For explanatory purposes, the example process 700 is described herein with reference to the brace device of FIGS. 1A-6D. Further for explanatory purposes, the blocks of the example process 700 are described herein as occurring in serial, or linearly. However, multiple blocks of the example process 700 may occur in parallel. In addition, the blocks of the example process 700 may be performed a different order than the order shown and/or one or more of the blocks of the example process 700 may not be performed. Further, any or all blocks of example process 700 may further be combined and done in parallel, in order, or out of order.

In FIG. 7, the exemplary method 700 of implementing a support device for supporting a limb, neck, chin, or head of a wearer is shown. Method 700 begins at block 701. In block 703, the method includes providing a rest surface, a stand surface, a connecting structure, and a band of a support device, the connecting structure coupling the rest surface to the stand surface.

In block 705, the method includes securing one or more portions of the band to the stand surface. In some embodiments, securing one or more portions of the band further comprises placing the band around the body, wherein the band extends between the stand surface and a first portion of the body and goes around a second portion of the body.

In block 707, the method includes placing a chin, limb, neck or head of a body on the rest surface. In some embodiments, the rest surface may include a non-planar portion, and supporting the limb, neck, chin, or head may further comprise placing the chin, limb, neck or head of the body on the non-planar portion of the rest surface. The non-planar portion may be concave for receiving the chin, limb, neck or head or convex for supporting the chin, limb, neck or head.

In block 709, the method includes placing the band around the body. In some embodiments, a collar or a padding may be placed on the band to provide better support or comfort for the wearer.

In block 711, the method includes repositioning the stand surface by detaching at least one portion of the one or more portions of the band from the stand surface.

In block 713, the method includes adjusting a flap mounted adjacent to or along an outer edge of the rest surface to position the chin, limb, neck or head of the body at a desired angle from the rest surface. In some embodiments, the rest surface includes one or more flaps attached at one or both ends of the groove on the upper surface of the support device. In some embodiments, at least one of the one or more flaps is pivotable from the outer edge of the rest surface, and placing the chin, limb, neck, or head on the rest surface further comprises adjusting the pivotable flap to position the chin, limb, neck or head of the body at a desired angle from the rest surface. The method ending in block 715.

The term "within a proximity", "a vicinity", "within a vicinity", "within a predetermined distance", "predetermined width", "predetermined height", "predetermined length" and the like may be defined between about 0.1 centimeter and about 0.5 meters. The term "coupled" is defined as connected, whether directly or indirectly through intervening components, and is not necessarily limited to physical connections. The connection may be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but may have one or more deviations from a true cylinder. The term "comprising," when utilized, means "including, but not necessarily limited to"; it specifically indicates open-ended inclusion or membership in the so-described combination, group, series and the like.

The term "a predefined" or "a predetermined" when referring to length, width, height, or distances may be defined as between about 0.1 centimeter and about 0.5 meters.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the present disclosure, the disclosure, the present disclosure, other variations thereof and alike are for convenience and do not imply that a disclosure relating to such phrase(s) is essential to the present disclosure or that such disclosure applies to all configurations of the present disclosure. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The word "exemplary" is used herein to mean "serving as an example, instance, or illustration." Any embodiment described herein as "exemplary" or as an "example" is not necessarily to be construed as preferred or advantageous over other embodiments. Furthermore, to the extent that the term "include", "have", or the like is used in the description or the claims, such term is intended to be inclusive in a manner similar to the term "comprise" as "comprise" is interpreted when employed as a transitional word in a claim.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

The embodiments shown and described above are only examples. Many details are often found in the art such as the other features of an image device. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A brace device, comprising:

a rest surface for resting at least one of a chin, limb, neck and head of a body;

a stand surface positioned to abut a surface of the body;

a connecting structure, the connecting structure configured as a single piece coupling the rest surface to the stand surface and comprising a bend positioned away from the distal ends of the connecting structure;

a distal end of the connecting structure configured to be fixed to the rest surface and an other distal end of the connecting structure configured to be fixed to the stand surface; and an attachment means provided on the stand surface for securing a band to the stand surface.

2. The brace device of claim 1, wherein the rest surface includes a non-planar portion for supporting at least one of the chin, limb, neck and head.

3. The brace device of claim 2, wherein the non-planar portion is concave.

4. The brace device of claim 1, wherein the stand surface comprises one or more openings, clips, screws, belts, buckles, hooks, or any combination thereof.

5. The brace device of claim 1, wherein the connecting structure extends at an angle from the stand surface.

6. The brace device of claim 1, further comprising a band, wherein the band includes a collar or a padding to support the chin, limb, neck or head.

7. The brace device of claim 1, further comprising a band, wherein the band extends between the stand surface and a first portion of the body and goes around a second portion of the body.

8. The brace device of claim 1, further comprising a band, wherein the band is detachable from the attachment means to facilitate repositioning of the rest surface.

9. The brace device of claim 1, wherein the rest surface further comprises one or more flaps mounted adjacent to an outer edge of the rest surface.

10. The brace device of claim 9, wherein at least one of the one or more flaps is pivotably connected to the rest surface to vertically position at least one of the chin, limb, neck and head above the rest surface.

11. The brace device of claim 1, wherein the rest surface, the connecting structure, and the stand surface together form one or more parts of a toy, a doll, or a stuffed animal.

12. A method of supporting at least one of a chin, limb, neck and head of a body, comprising:

providing a rest surface for resting the chin, limb, neck or head of the body;

providing a stand surface positioned to abut a surface of the body;

coupling, by a connecting structure, the rest surface to the stand surface, the connecting structure configured as a single piece and comprising a bend positioned away from the distal ends of the connecting structure;

configuring a distal end of the connecting structure to be fixed to the rest surface and an other distal end of the connecting structure to be fixed to the stand surface; and securing one or more portions of a band to the stand surface.

13. The method of claim 12, wherein the rest surface includes a non-planar portion, and supporting at least one of the chin, limb, neck and head, further comprises placing the chin, limb, neck or head on the non-planar portion of the rest surface.

14. The method of claim 13, wherein the non-planar portion is concave for receiving the chin, limb, neck or head.

15. The method of claim 13, wherein the non-planar portion is convex for supporting the chin, limb, neck or head.

16. The method of claim 12, further comprising placing a collar or a padding on the band.

17. The method of claim 12, further comprising placing the band around the body, wherein the band extends between the stand surface and a first portion of the body and goes around a second portion of the body.

18. The method of claim 12, further comprising repositioning the stand surface on the body by detaching at least one portion of the one or more portions of the band from the stand surface.

19. The method of claim 12, wherein the rest surface includes one or more flaps mounted adjacent to an outer edge of the rest surface, and placing at least one of the chin, limb, neck and head on the rest surface comprises positioning the chin, limb, neck or head between the rest surface and the one or more flaps.

20. The method of claim 19, wherein at least one of the one or more flaps is pivotably attached to the rest surface, and placing at least one of the chin, limb, neck, and head on the rest surface further comprises adjusting the at least one pivotable flap to vertically position the chin, limb, neck or head at a desired angle from the rest surface.

* * * * *